United States Patent [19]

Jäggle et al.

[11] Patent Number: 4,545,354

[45] Date of Patent: Oct. 8, 1985

[54] FUEL INJECTION VALVE

[75] Inventors: Günther Jäggle, Stuttgart; Walter Schönemann, Waiblingen, both of Fed. Rep. of Germany

[73] Assignee: Robert Bosch GmbH, Stuttgart, Fed. Rep. of Germany

[21] Appl. No.: 539,851

[22] Filed: Oct. 7, 1983

[30] Foreign Application Priority Data

Nov. 3, 1982 [DE] Fed. Rep. of Germany ..... 3240554

[51] Int. Cl.[4] ..... F02M 39/00

[52] U.S. Cl. ..... 123/470; 123/531; 123/585; 123/452

[58] Field of Search ..... 123/470, 471, 472, 452, 123/531, 585; 239/88-95

[56] References Cited

U.S. PATENT DOCUMENTS

| | | | |
|---|---|---|---|
| 4,006,719 | 2/1977 | Kanada | 123/531 |
| 4,136,653 | 1/1979 | Knapp et al. | 123/452 |
| 4,141,330 | 2/1979 | Schlott | 123/452 |
| 4,174,511 | 11/1979 | Knapp | 123/452 |
| 4,193,384 | 3/1980 | Steiner et al. | 123/452 |
| 4,216,757 | 8/1980 | Romann | 123/452 |
| 4,227,501 | 10/1980 | Knapp et al. | 123/452 |
| 4,280,661 | 7/1981 | Tanasawa et al. | 123/472 |
| 4,351,304 | 9/1982 | Schweizer | 123/472 |
| 4,354,470 | 10/1982 | Miyaki | 123/472 |
| 4,361,126 | 10/1982 | Knapp | 123/472 |
| 4,364,362 | 12/1982 | Wissmann et al. | 123/452 |
| 4,370,967 | 2/1983 | Gmelin et al. | 123/452 |
| 4,383,513 | 5/1983 | Gmelin et al. | 123/452 |
| 4,428,356 | 1/1984 | Kemmner | 123/585 |
| 4,434,766 | 3/1984 | Matsuoka | 123/472 |

FOREIGN PATENT DOCUMENTS

| | | | |
|---|---|---|---|
| 0183559 | 11/1982 | Japan | 123/472 |
| 1270945 | 7/1969 | United Kingdom | 123/472 |
| 2031995 | 4/1980 | United Kingdom | 123/470 |

OTHER PUBLICATIONS

Bosch Technical Instruction for Continuous Injection System Publication dated Feb. 1974.

*Primary Examiner*—Carl Stuart Miller
*Attorney, Agent, or Firm*—Edwin E. Greigg

[57] ABSTRACT

A fuel injection valve which serves to inject fuel in an internal combustion engine. The fuel injection valve includes a nozzle holder in which a nozzle body having an injection port is disposed. The injection port is opened by a closing body movable counter to the force of a closing spring in order to eject fuel. A gas guidance sheath encompasses the nozzle holder with a cylindrical portion and the nozzle body with a bottom portion and has at least one axially extending gas guidance conduit communicating with an air source. The gas guidance conduit leads to a gas ring conduit in the bottom portion. The nozzle step protrudes through the bottom portion and with the passageway opening thereof forms a throttling gas ring gap immediately above the injection port, so that fuel emerging from the injection port can immediately be enveloped by gas, such as air or exhaust gas, and thereby prepared.

5 Claims, 3 Drawing Figures

FUEL INJECTION VALVE

BACKGROUND OF THE INVENTION

The invention is based on a fuel injection valve for an internal combustion engine. A fuel injection valve is already known in which a provision is made for enveloping the injected fuel in air downstream of the fuel injection opening. In order to save energy, both the idling rpm and the friction of internal combustion engines have been reduced. As a result, the fuel mixture quantity required during engine idling in fuel-injected engines has decreased, and previously known injection valves with air preparation tend, at these extremely small idling fuel quantities, to form droplets, causing erratic operation of the engine and resulting in a larger proportion of toxic components in the exhaust gas.

OBJECT AND SUMMARY OF THE INVENTION

The fuel injection valve according to the invention has the advantage over the prior art that even the smallest injected fuel quantities undergo optimal preparation, and the injected fuel can emerge unhindered, even without being enveloped in air.

A particularly advantageous feature of the present invention is the adaptation of the gas ring gap to the requirements of an individual engine cylinder by displacing or bending the gas guidance sheath.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
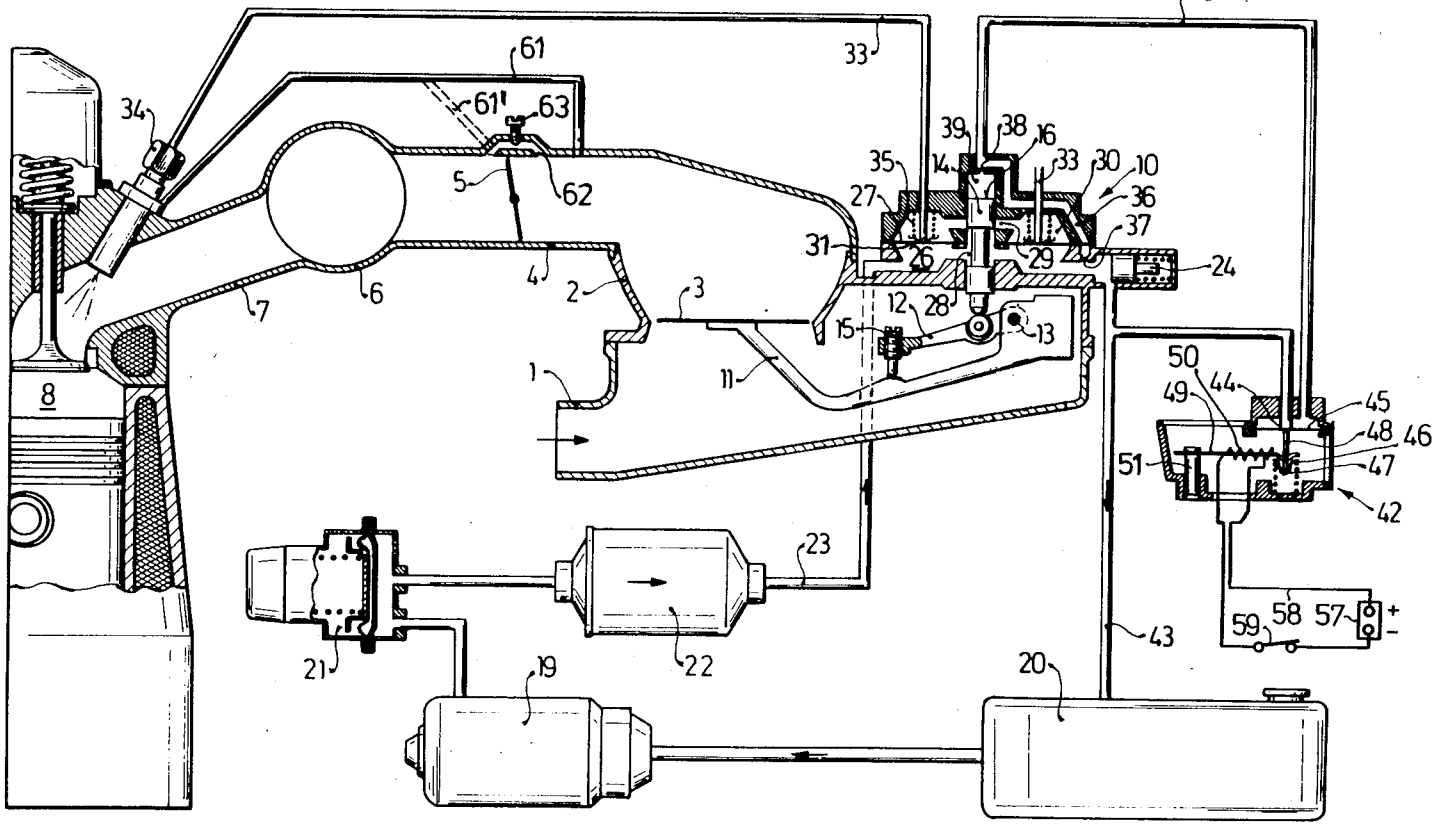
FIG. 1, in simplified form, shows a fuel injection system having a fuel injection valve.

In the fuel injection system shown by way of example in FIG. 1, the air for combustion flows in the direction of the arrow via an intake tube section 1 into a conical passage 2, in which there is disposed an air flow rate meter 3, and on through an intake tube section 4 having a throttle valve 5 controllable at will, and then to an intake manifold 6 and from there via an intake tube section 7 to one or more cylinders 8 of a mixture-compressing internal combustion engine having externally supplied ignition. The air flow rate meter 3 is a plate 3 disposed transversely with respect to the flow direction. The plate which moves within the conical section 2 of the intake tube in accordance with an approximately linear function, for example, of the quantity of air flowing through the intake tube. For a constant restoring force engaging the air flow rate meter as well as a constant air pressure prevailing ahead of the air flow rate meter, the pressure prevailing between the air flow rate meter 3 and the throttle valve 5 likewise remains constant. The air flow rate meter 3 controls a metering and quantity distributing valve 10. The regulatory movement of the air flow rate meter 3 is transmitted by a pivot lever 11 connected therewith. The pivot lever 11 is supported in common with a correction lever 12 on a pivot point 13 and upon executing its pivoting movement actuates the movable valve member, embodied as a control plunger 14, of the metering and quantity distributing valve 10. The desired fuel-air mixture can be adjusted at a mixture regulating screw 15. The end face 16 of the control plunger 14 remote from the pivot lever 11 is acted upon by pressure fluid, the pressure of which, exerted upon the end face 16, generates the restoring force upon the air flow rate meter 3.

The supply of fuel is effected by means of an electric fuel pump 19, which aspirates fuel from a fuel container 20 and delivers it via a fuel reservoir 21, a fuel filter 22 and a fuel supply conduit 23 to the metering and quantity distributing valve 10. A system pressure regulator 24 keeps the system pressure in the fuel supply conduit 23 constant.

The fuel supply line 23 leads via various branches to chambers 26 of the metering and quantity distributing valve 10, so that one side of a diaphragm 27 is acted upon by the fuel pressure. The chambers 26 likewise communicate with an annular groove 28 of the control plunger 14. Depending upon the position of the control plunger 14, the annular groove 28 opens a greater or lesser number of metering slits 29, each of which leads to a respective chamber 30 which is separated from the chamber 26 by the diaphragm 27. From the chambers 30, the fuel passes via valve seats 31 into injection conduits 33 leading to the individual fuel injection valves 34, which are disposed in the vicinity of the engine cylinders 8 in the intake tube section 7. The diaphragm 27 serves as the movable element of a flat seat valve, which is kept open by a spring 35 when the fuel injection system is not in operation. The diaphragm boxes each formed by one chamber 26 and 30 cause the pressure drop at the metering valves 28, 29 to be substantially constant, independently of the amount of overlap between the annular groove 28 and the control slits 29 or in other words independently of the quantity of fuel flowing to the fuel injection valves 34. It is thereby assured that the length of the adjustment movement of the control plunger 14 and the metered fuel quantity will be proportional to one another.

Upon a pivoting movement of the control lever 11, the air flow rate meter 3 positioned in the conical section 2 is inclined, so that the changing annular cross section between the air flow rate meter and the cone is approximately proportional to the regulatory movement of the air flow rate meter 3.

The pressure fluid generating the constant restoring force exerted on the control plunger 14 is the fuel. To this end, a control pressure line 36 branches off from the fuel supply conduit 23, being separated from the fuel supply conduit 23 by an offtake choke bore 37. The control pressure conduit 36 communicates, via a damping throttle 38, with a pressure chamber 39 into which the control plunger 14 protrudes with its end face 16.

A pressure regulating valve 42 by way of which the pressure fluid can flow without pressure through a return-flow conduit 43 to the fuel container 20 is disposed in the control pressure conduit 36. One function of the pressure regulating valve 42 is to vary the pressure of the pressure fluid generating the restoring force during the warmup phase of the engine in accordance with a temperature and time function.

The pressure regulating valve 42 is embodied as a flat seat valve, having a fixed valve seat 44 and a diaphragm 45 serving as a movable valve element. The diaphragm 45 is biased in the closing direction of the valve by a compression spring 46. The compression spring 46 acts via a spring cap 47 and a transmission stud 48 upon the diaphragm 45. At temperatures below the engine operating temperature of approximately 80° C., the spring force of the compression spring 46 counteracts a bimetallic spring 49, on which an electrical heating element 50 is disposed, the heating up of which after engine starting causes a reduction in the force exerted by the bimetallic spring 49 on the compression spring 46, so that as a result the control pressure in the control pressure conduit 36 increases. To this end, the electrical heating element 50 of the bimetallic spring 49 is connected to the vehicle battery 57 in a current circuit 58 which is closed by the ignition and starting switch 59. The bimetallic spring 49 is fastened to an adjusting screw 51 at its end remote from the compression spring 46 and is adjustable by means of this screw 51 in its position relative to the compression spring 46.

Below an engine operating temperature of approximately +80° C., it is necessary to enrich the fuel-air mixture with fuel during the engine warmup phase. This purpose is served by the bimetallic spring 49, by means of which the force of the compression spring 46 on the diaphragm 45 can be reduced. A reduction of the closing force on the diaphragm 45 causes a lower control pressure to be established in the control pressure conduit 36, so that the restoring force on the control plunger 14 and thus on the air flow rate meter 3 is likewise decreased, as a result of which, if the aspirated air quantity remains the same, the control plunger 14 is displaced further in the opening direction of the metering slits 29, and a larger quantity of fuel is metered. At starting temperatures above approximately +80° C., the bimetallic spring 49 will have bent so far toward the diaphragm 45 that it is disengaged from the spring plate 47, causing the control pressure in the control pressure conduit 36 regulated by the pressure regulating valve 42 to be determined solely by the force of the compression spring 46.

In low-pressure systems of this kind, to attain good preparation of the fuel to be injected it is necessary at these minimum fuel injection quantities during idling and at partial load to provide for an atomization of the fuel by means of a gas, for instance air or exhaust gas. The gas source may be compressed air, for example, or as shown here air from the atmosphere, which is diverted, for instance, upstream of the throttle valve 5 from the intake tube section 4 and delivered via an air conduit 61 to the fuel injection valve 34. The air conduit 61, in the form shown here, is located parallel to an idling bypass conduit 62 around the throttle valve 5 having a conventional idling regulation screw 63. To regulate a constant idling rpm, a further bypass, not shown, may be provided around the throttle valve 5, the cross section of which is regulatable in a known manner by an idling regulation system in accordance with the idling rpm and temperature. The idling bypass conduit 62 can also be embodied such that downstream of the idling regulating screw 63 it discharges not into the intake tube but rather into an air conduit 61' shown in dashed lines, which leads to the individual fuel injection valves 34, so that the quantity of air flowing via the idling bypass conduit 62 to the fuel injection valves 34 serves to prepare the fuel which is to be injected.

The air conduit 61 could also, although this is not shown, branch off from the intake tube section 1 upstream of the air flow rate meter 3, thereby making available a greater pressure drop to the intake tube pressure at the location of fuel injection. Or, as again not shown, the air conduit 61 could be connected to the exhaust system of the engine, so that exhaust gas is used for preparing the fuel to be injected, as a result of which a sufficiently high pressure for transporting the fuel is available even in the full-load range of the engine.

Figure 2:
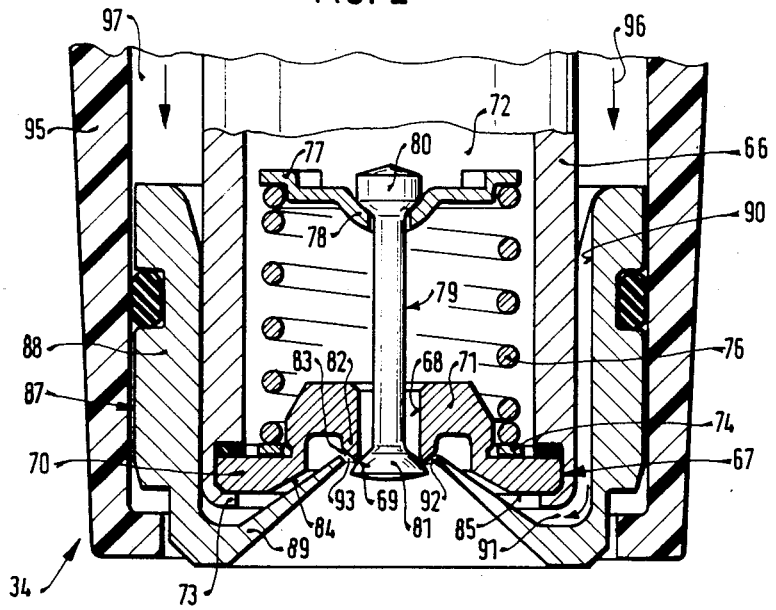
FIG. 2 shows a first exemplary embodiment of a fuel injection valve equipped in accordance with the invention.
Figure 3:
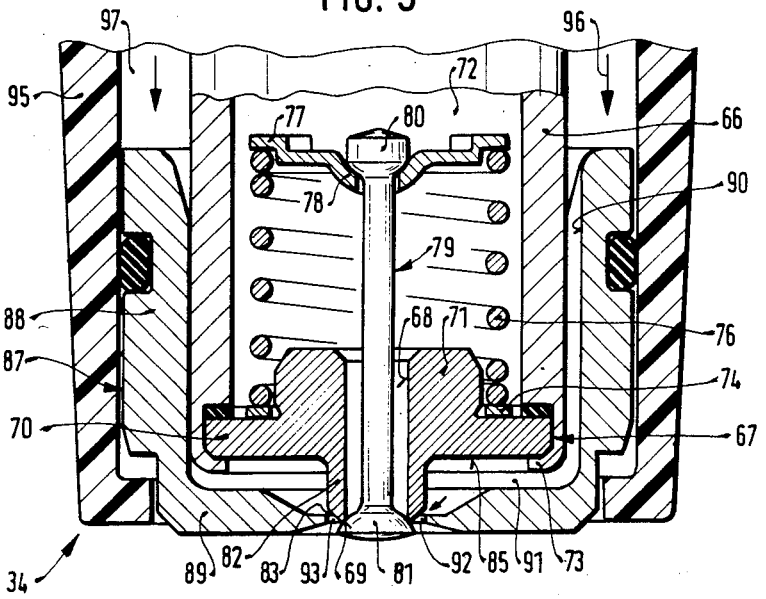
FIG. 3 shows a second exemplary embodiment of a fuel injection valve embodied in accordance with the invention.

FIGS. 2 and 3 show exemplary embodiments of the fuel injection valve 34 for preparing the fuel to be injected with a gas, especially with air.

The exemplary embodiment of a fuel injection valve 34, a sectional view of only part of which is shown, has a nozzle holder 66, in one end of which a nozzle body 67 is disposed and secured. The nozzle body 67 has a central opening 68, which discharges toward the outside in an injection port 69 serving simultaneously as the valve seat. The nozzle body 67 is fastened to the nozzle holder 66 via a flange 70 and protrudes with a guidance step 71 in a pressure chamber 72 formed in the nozzle holder 66. The pressure chamber 72 communicates with the injection conduit 33 for fuel supply. The securing of the nozzle body 67 on the nozzle holder 66 may be effected by means of a crimped rim 73, which surrounds and engages part of the flange 70. A closing spring 76, which surrounds and engages the guidance step 71, is supported on the flange 70, possibly via an interposed disc 74; the closing spring 76 protrudes into the compression chamber 72 and its other end acts upon a spring plate 77. The spring plate 77 has a hemispherical concavity in its middle region 78, on which a closing body 79 is suspended at one end from a supporting head 80 having a ball-like section. The closing body 79 on its opposite end oriented toward the nozzle body 67 has a closing head 81 that is an extension of the end of the closing body 79 protruding through the central opening 68 of the nozzle body 67 and, in cooperation with the injection port 69 forms the actual valve. The closing body 79 is thus suspended such that it is free to swing relative to the nozzle body 67 when disengaged from the injection port 69. A nozzle step 82 is formed on the nozzle body 67 remote from the pressure chamber 72, on the end of which nozzle step 82 the injection port 69 is embodied. Extending toward the injection port 69, the nozzle step 82 is provided with an inclined, annular bevel face 83, so that the nozzle step 82 tends to a point toward the injection port 69. The nozzle step 82 as embodied is so short, in the exemplary embodiment of the fuel injection valve 34 of FIG. 2, that it terminates inside a recess 84 of the nozzle body 67. That is, the nozzle step does not protrude outward beyond the end face 85 of the flange 70 remote from the pressure chamber 72.

For preparing the fuel to be injected, a cup-shaped gas guidance sheath 87 is provided that has a cylindrical portion 88 which at least partially surrounds the nozzle holder 66 axially and with a bottom portion 89 which at least partially radially covers the nozzle body 67. Embodied in the cylindrical portion 88 is at least one axial gas guidance conduit 90, which is defined in part by the circumference of the nozzle holder 66 and which communicates at its end as viewed in the drawing with the air conduit 61, 61' while at its lower end it discharges into a gas ring conduit 91, which is formed between the recess 84, or the end face 85 of the flange 70, and the bottom portion 89 surrounding the flange. The bottom portion 89 is embodied such that a central passageway opening 92 of the bottom portion 89 has the nozzle step 82 protruding through it. Between the wall of the passageway opening 92, which is open toward the gas ring conduit 91, and the bevel face 83 on the nozzle step 82, a throttling gas ring gap 93 is formed, in which the air metering—that is, the conversion of pressure into speed—takes place. As a result of the bevel face 83 of the nozzle step 82 located in the vicinity of the passageway opening 92 of the bottom portion 89, the cross section of the gas ring gap 93 can be varied either by the axial displacement of the gas guidance sheath 87 or by a corresponding bending of the bottom portion 89. In other words, the central areas of the bottom portion 89 oriented toward the nozzle step 82 and encompassing the passageway bore 92 are to be bent more or less in an axial direction toward the nozzle step 82, so that the cross section of the gas ring gap 93 changes. The gas ring gap 93 should be formed as near as possible to the immediate vicinity of the injection port 69; that is, it should be located no more than a few tenths of a millimeter above the fuel emerging from the injection port 69. As a result, the fuel ejected through the injection port 69 is enveloped on all sides by air at a high flow rate immediately after it emerges from the injection port and is thereby prepared. The face of the bottom portion 89 remote from the nozzle body 67 is embodied with a wide-mouth funnel-like course, so that even if air preparation is absent, fuel emerging from the injection port 69 is not capable of moistening this surface.

The injection valve 34 may be surrounded by an insulating sheath 95, which to the maximum possible extent prevents the conduction of heat to the injection valve 34. As indicated by arrows 96, an annular chamber 97 may be formed between the nozzle holder 66 and the insulating sheath 95, communicating at one end with the air conduit 61, 61' and toward which on the other end the gas guidance conduits 90 are open.

The exemplary embodiment shown in FIG. 3 for a fuel injection valve 34 having fuel preparation by means of a gas differs from the exemplary embodiment of FIG. 2 solely in that the nozzle step 82 as embodied is of a length that, protruding outward beyond the flange 70 from the nozzle body 67, it extends into the plane of the bottom portion 89, which here is embodied as virtually flat, of the gas guidance sheath 87. As a result, the severely tapered funnel-like embodiment of the bottom portion 89 becomes unnecessary, although the manner of fuel preparation of the fuel injected via the injection port 69 remains identical.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection valve for internal combustion engines comprising a substantially cylindrical nozzle holder having a nozzle body mounted therein, said nozzle body having a central opening provided with an injection port (at one end) a nozzle step on said injection port acting as a valve seat, a gas guidance sheath having an axially extending cylindrical portion at least partially axially containing said nozzle holder and a radially extending bottom portion at least partially covering said nozzle body, at the injection port end thereof at least one axially extending gas guidance conduit in said sheath cylindrical portion adapted to discharge gas into a gas ring conduit located between said injection port end of the nozzle body and said guidance sheath bottom portion, a throttling gas ring gap in communication with the gas ring conduit, said gas ring gap being located between the passageway opening of said sheath bottom portion and said nozzle step in the immediate vicinity of said injection port and said nozzle step arranged to protrude through said passageway opening.

2. A fuel injection valve according to claim 1, in which the nozzle step has an inclined level face beginning at the injection port and oriented toward the passageway opening, and said gas ring gap lies between said level face and the passageway opening.

3. A fuel injection valve according to claim 2, in which the cross section of the gas ring gap is determined by the axial placement of the gas guidance sheath and the spacing of its bottom portion on the nozzle holder relative to the injection port.

4. A fuel injection valve according to claim 2, in which said fuel guidance sheath bottom portion is axially formed such that the cross section of the gas ring gap is determined by the degree to which the bottom portion is offset relative to the injection port.

5. A fuel injection valve according to claim 1, in which the gas deliverable to the gas ring gap comprises air or engine exhaust gas.

* * * * *